US005494458A

United States Patent [19]

Casey et al.

[11] Patent Number: 5,494,458

[45] Date of Patent: Feb. 27, 1996

[54] ULTRA-LOW PROFILE MATABLE ELECTRICAL CONNECTOR ASSEMBLY

[75] Inventors: Daniel T. Casey, Harrisburg; Terry R. Chubb, Mt. Joy; Craig W. Wert, Shermans Dale, all of Pa.

[73] Assignee: The Whitaker Corporation, Wilmington, Del.

[21] Appl. No.: 202,304

[22] Filed: Feb. 25, 1994

[51] Int. Cl.[6] ..... H01R 9/07

[52] U.S. Cl. ..... 439/495

[58] Field of Search ..... 439/60, 495, 496

[56] References Cited

U.S. PATENT DOCUMENTS

| | | | |
|---|---|---|---|
| 4,048,593 | 9/1977 | Zillman | 333/70 R |
| 4,591,814 | 5/1986 | Ito et al. | 333/177 |
| 4,664,456 | 5/1987 | Blair et al. | 339/14 P |
| 4,786,258 | 11/1988 | Shaffer et al. | 439/188 |
| 5,151,042 | 9/1992 | Okada | 439/169 |
| 5,239,748 | 8/1993 | Hamilton | 439/60 X |
| 5,316,486 | 5/1994 | Tanaka | 439/496 X |
| 5,326,272 | 7/1994 | Harhen et al. | 439/86 |
| 5,334,057 | 8/1994 | Blackwell | 439/839 |

*Primary Examiner*—Larry I. Schwartz
*Assistant Examiner*—Daniel Wittels
*Attorney, Agent, or Firm*—Anton P. Ness

[57] ABSTRACT

A mating connector assembly 10, 100 defining an ultra-low profile mating interface, with plug and receptacle connectors 10 and 100 mounted on opposed adjacent surfaces of panels 12, 102 slidably movable along each other. Plug connector 10 including a pair of spring arm contact members 14, 16 affixed to an end portion of a first flexible film circuit element 22 and extending from a housing 50. Receptacle connector 100 includes a transverse second flexible film circuit element 122 traversing a contact-receiving cavity 116 of second housing 130, with contact pads engaged by contact surfaces 42, 44 of contact members 14, 16 upon connector mating.

23 Claims, 6 Drawing Sheets

ULTRA-LOW PROFILE MATABLE ELECTRICAL CONNECTOR ASSEMBLY

FIELD OF THE INVENTION

This relates to the field of electrical connectors and more particularly to matable connectors mounted to separate relatively movable articles.

BACKGROUND OF THE INVENTION

On occasion it is desired to provide mating connector halves that are mounted to separate articles and that become mated to each other to complete one or more electrical circuits, upon the movement of the separate articles with respect to each other. U.S. Pat. No. 4,664,456 is representative of an arrangement where one connector is mounted to a transverse panel or other framework in a cutout therethrough, and the other connector is mounted to a transverse leading end of a rack or drawer movable toward and to the panel whereupon the connectors enter into a mated relationship; the connector housings are provided with a cooperating set of alignment posts and apertures such that one of the connectors which is float mounted may adjust its position incrementally transversely thus accurately aligning its array of contacts with the contact array of the other connector which is fixedly mounted.

Switches are occasionally needed to detect the movement of two articles to a particular position with respect to each other, from another particular position. For example, it may be desired to provide an apparatus of at least two parts movable with respect to each other from a first position to a second position, and to assure that the parts have been moved completely along a predetermined path to the second position. In U.S. Pat. No. 4,786,258 a connector assembly includes in one of its connectors an electrical shunt between two of the several contacts therein defining a closed loop indicative of an unmated condition, and the other connector includes a dielectric post which engages the shunt upon connector mating and deflects it out of engagement with the two contacts breaking the closed loop circuit and is indicative of a fully mated condition.

It is desired to provide a matable electrical connector assembly wherein the mating halves are mounted to respective parts of an apparatus, aligned with each other in spaced apart relationship when the apparatus parts are in a first position.

It is further desired to provide such a connector arrangement wherein one of the connector halves is secured to a surface of one of the parts, and the other connector half is secured to an opposed adjacent surface of the other part, with the surfaces generally parallel to the direction of relative movement of the parts such that when the parts are moved from the first position to the second position with the surfaces moved slidably along and near or against each other.

It is also desired to provide low profile connector halves that mate at a mating interface of minimal height, enabling the parts to comprise a minimized thickness and serve as thin-walled panels or shells, including nested cylinders assembled in a manner permitting relative rotation between first and second positions of inner and outer cylinders.

SUMMARY OF THE INVENTION

The present invention includes an electrically connective assembly of first and second matable connective arrangements defined on first and second articles and that are referred to hereinafter for convenience as a plug connector and a receptacle connector. The articles may be panels having opposed parallel surfaces and movable sideways relative to each other from a first position along a fixed path to a second position, and may be cylindrical shells one within the other relatively rotatable about a common axis a certain angular distance. The connectors have an ultra-low profile and are disposed on opposing closely spaced surfaces parallel to the direction of movement of the articles, with one or both thereof extending a limited distance orthogonally across the gap between the opposed surfaces, to oppose the mating face of the other connector.

The plug connector includes a pair of flat spring arm contact members having major surfaces opposing each other and extending to leading ends at the plug's mating face which initially converge at contact surfaces and then diverge to define a lead-in for receipt of a mating contact means thereinto during connector mating. Each of the spring arm contact members is electrically connected to a respective circuit, are supported by a housing means with sufficient strength to enable spring-biased deflection of their leading ends upon connector mating while not stressing the connections to their circuits. The receptacle connector can comprise a blade-shaped dielectric member traversing a contact-receiving recess at a mating face, mounted to oppose the diverging leading ends of the spring arm contact members to be received edgewise therebetween. The blade-shaped member includes contact pads on opposed major surfaces of the blade-shaped member connected to respective circuits of the second article and electrically engageable with corresponding ones of the spring arm contact members of the plug connector upon mating.

It is an objective of the present invention to provide complementary connective arrangements matable to complete at least one electrical circuit and together having an ultra-low profile.

It is another objective to provide such an ultra-low profile connective system adapted to be defined between closely spaced opposing surfaces parallel to the direction of movement of the articles such that the surfaces are slidable along each other.

It is further an objective that the connective arrangements define a very low mating interface height such that each connector may have an ultra-low profile to be disposed between upper and lower surfaces of articles comprising thin-walled structures.

It is yet another objective to provide such a connective assembly to complete at least two circuits between the articles, wherein at least one of the connective arrangements includes contact members connected to two of the circuits and initially engaging each other prior to the articles being moved fully to the second actuated position, forming a closed loop circuit, with the contact members adapted to be disengaged from each other upon mating.

It is additionally an objective to provide that upon mating of the connective arrangements, the associated contact means become electrically engaged with sufficient contact normal force assuring the completion of the at least one circuit.

An embodiment of the present invention will now be described by way of example with reference to the accompanying drawings.

DETAILED DESCRIPTION OF THE PREFERRED EMBODIMENT

Figures 1, 2:
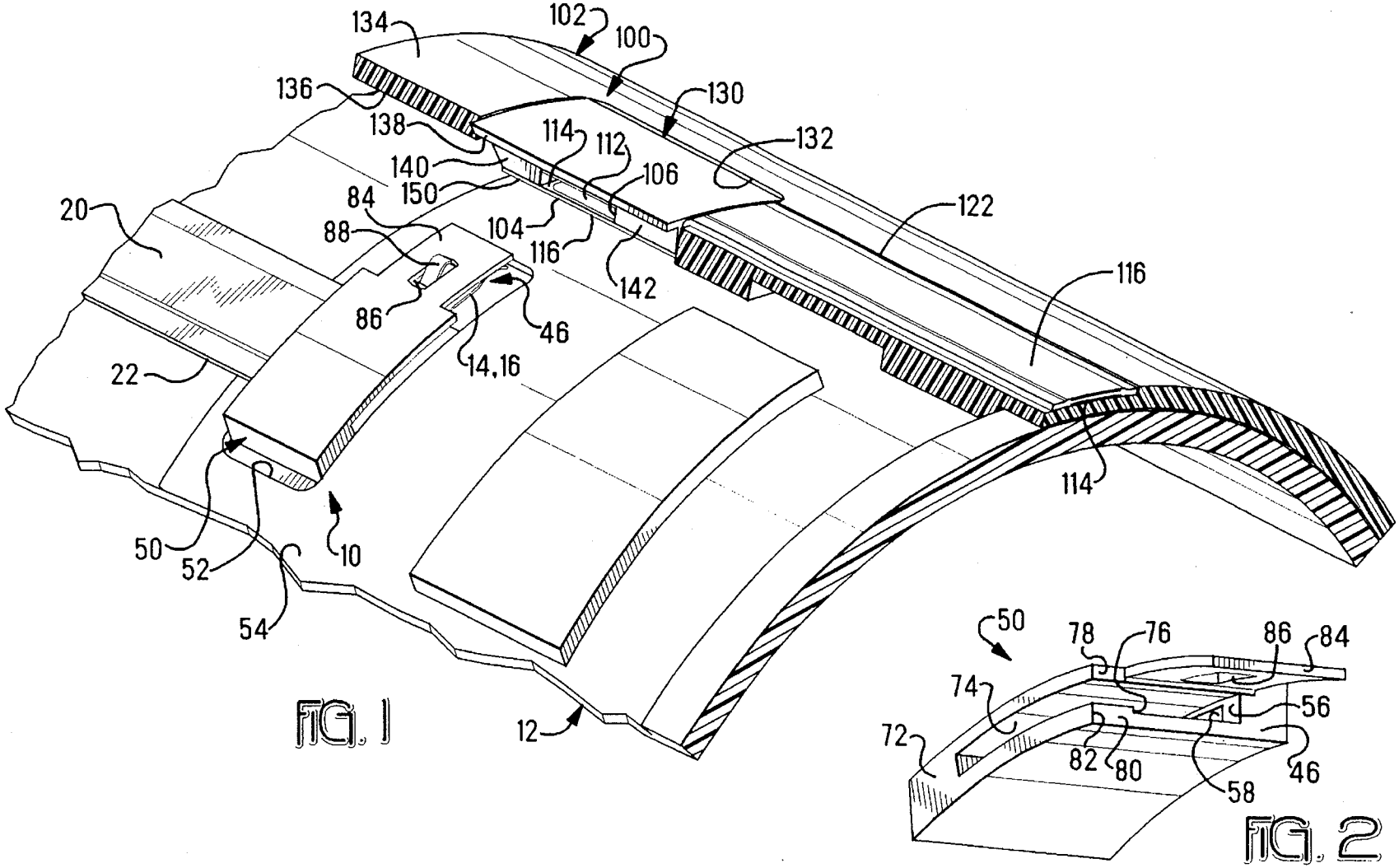
FIG. 1 is an isometric view of the plug and receptacle connectors of the present invention, defined on a pair of nested cylindrical shell members relatively rotatable to mate the connective arrangements.
FIG. 2 is an isometric view of the housing of the plug connector of FIG. 1.

FIG. 1 illustrates a matable assembly of first and second complementary connective arrangements 10, 100 which may be discrete connectors mounted on articles which may be cylindrical shells 12, 102 shown partially sectioned, although the articles could be flat parallel panels relatively slidable one over the other in a path parallel to both. Cylindrical shells 12, 102 are assembled one within the other, or nested, and are constrained to be moved relative to each other in an arcuate path about the common axis of the cylinders, preferably inclusive of bearing surfaces and embossments maintaining them a fixed incremental distance apart and also precisely guiding their movement between first and second positions. The embossments can be said to define a groove therebetween within which a portion of one or both connective arrangements can be said to be disposed to move along their mating axis. The connective arrangements 10, 100 are shown to accommodate a pair of circuits which become completely continuous upon mating of the connective arrangements at a mating interface when the cylindrical shells are relatively rotated from the first position to the second position.

Figure 3:
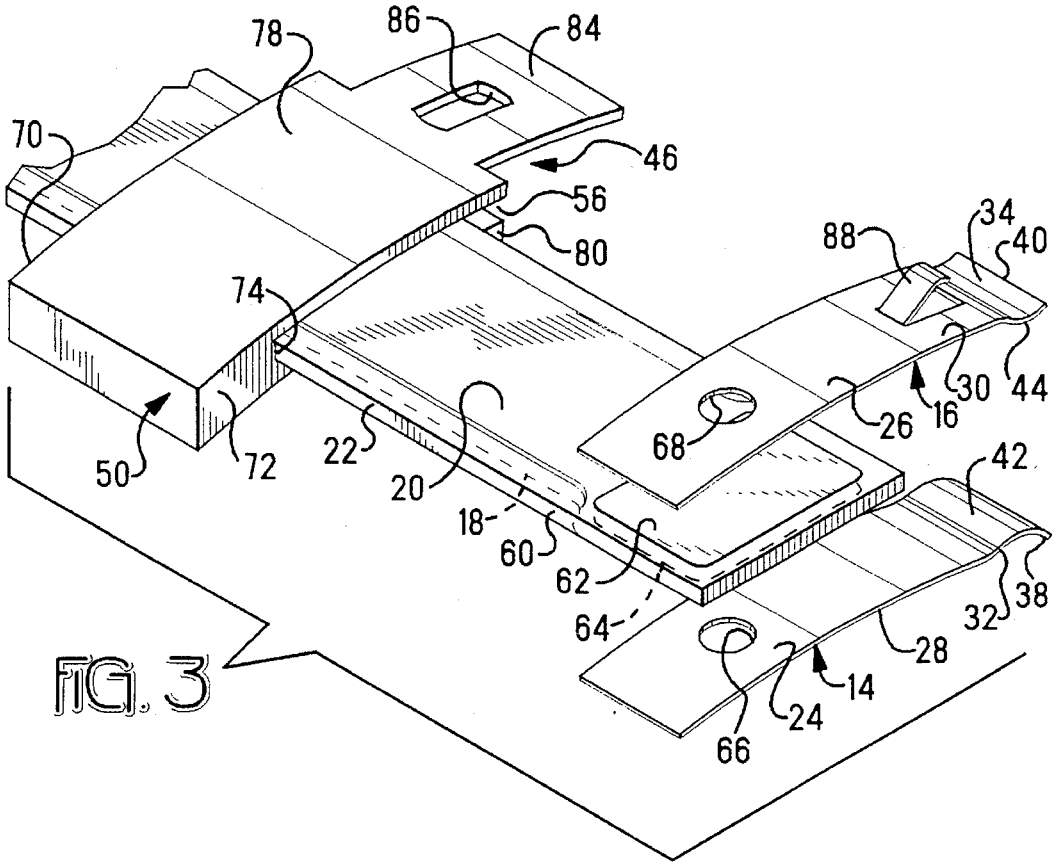
FIG. 3 is an isometric view of the plug connector housing of FIGS. 1 and 2 showing a pair of contact members exploded therefrom, securable therein and connectable to conductors of a flexible film circuit element extended therethrough.

First connective arrangement 10 will be referred to as plug connector 10, which as seen in FIGS. 1 to 3 includes a pair of flat spring arm contact members 14, 16 electrically connected to circuits extending from plug connector 10 to an electrical article (not shown) at another location on shell 12. The circuits may be defined by conductors 18, 20 of a flexible film circuit 22 that are separated by a film of dielectric insulation material and also covered by layers of such dielectric insulation material. The plug connector can include a discrete dielectric housing member 50, as shown in FIG. 2, nested in a pocket or recess 52 extending to outer surface 54 of shell 12. Alternatively, were shell 12 to be of dielectric material, the shell could be so formed as to define a housing means obviating the need for a discrete housing member to be affixed to the shell.

Contact members 14, 16 include body sections 24, 26 and spring arm sections 28, 30 which extend to arcuate sections 32, 34 converging toward each other at constriction 36 (best seen in FIG. 5) and to free ends 38, 40 which diverge to define an entrance for receipt of a blade shaped member of the receptacle connector therebetween during mating. Contact members 14, 16 at arcuate sections 32, 34 have major surfaces opposed to each other at constriction 36 defining contact surfaces 42, 44 that will bear against the blade-shaped member received therebetween during mating. Free ends 38, 40 are exposed at mating face 46 of plug arrangement 10, and body sections 24, 26 of both contact members 18, 20 are affixed to flexible film circuit element 22. Contact members 14, 16 and their terminations to conductors 18, 20 are affixed and housed in cavity 56 of housing member 50, with flexible film member 22 extending from a cable exit 58 remote from mating face 46 thereof.

End portion 60 of flexible film circuit element 22 includes contact pads 62, 64 exposed on opposed major surfaces thereof connected to respective circuits 18, 20 of element 22. Body sections 30, 32 of contact members 14, 16 are joined to the contact pads 62, 64 by soldering, forming an assured electrical connection between each contact member and the corresponding discrete circuit. Apertures 66, 68 formed in body sections 30, 32 of respective contact members 14, 16 result in solder fillet formation upon soldering, improving the strength of the respective solder joints.

One manner of assembly of plug connector 10 may involve inserting flexible film element 22 through cable exit 58 at cable side 70 of housing member 50 until end portion 60 extends beyond opposed side 72 and contact pads 62, 64 are accessible for affixing the contact members. As seen in FIG. 2, opposed side 72 includes an opening 74 in communication with mating face 46 and the entrance to cavity 56. After the contact members are joined to end portion 60, the contact subassembly thus formed is pulled back into cavity 56 until body sections 30, 32 are seated therein, with the height of cavity 56 closely corresponding to the ultimate thickness of the contact subassembly. Cavity 56 preferably includes at least one ledge 76 facing cavity 56 along opposed side 72 that will extend along side edges of the contacts upon seating of the contact subassembly within cavity 56, thereby accurately positioning and constraining the contact subassembly from further lateral movement thereafter and providing strain relief thereto; optionally opposing upper and lower ledges may be used. When the contact subassembly is being urged through opposed side 72, the upper and lower portions 78, 80 of housing 50 adjacent corner 82 are slightly deflected to permit contact members 14, 16 to be moved through opening 74, after which the upper and lower housing portions 78, 80 resile to seat the contact subassembly. Thereafter, the housing provides sufficient strength at the solder terminations of body sections 24, 26 to contact pads 62, 64 to enable spring-biased deflection of spring arms 28, 30 apart upon receipt of the blade shaped member of the receptacle connector therebetween upon connector mating, without substantial strain on the terminations. Housing member 50 is shown to include a tab section 84 extending forwardly from upper housing portion 78 at mating face 46 to provide a measure of physical and insulative protection for spring arm sections 28, 30 of contact members 14, 16. Tab section 84 is further shown to include an opening 86 through which protrudes a spring finger 88 of contact member 16 (see FIGS. 1 and 5 to 8), the utility of which will be explained shortly.

Figure 4:
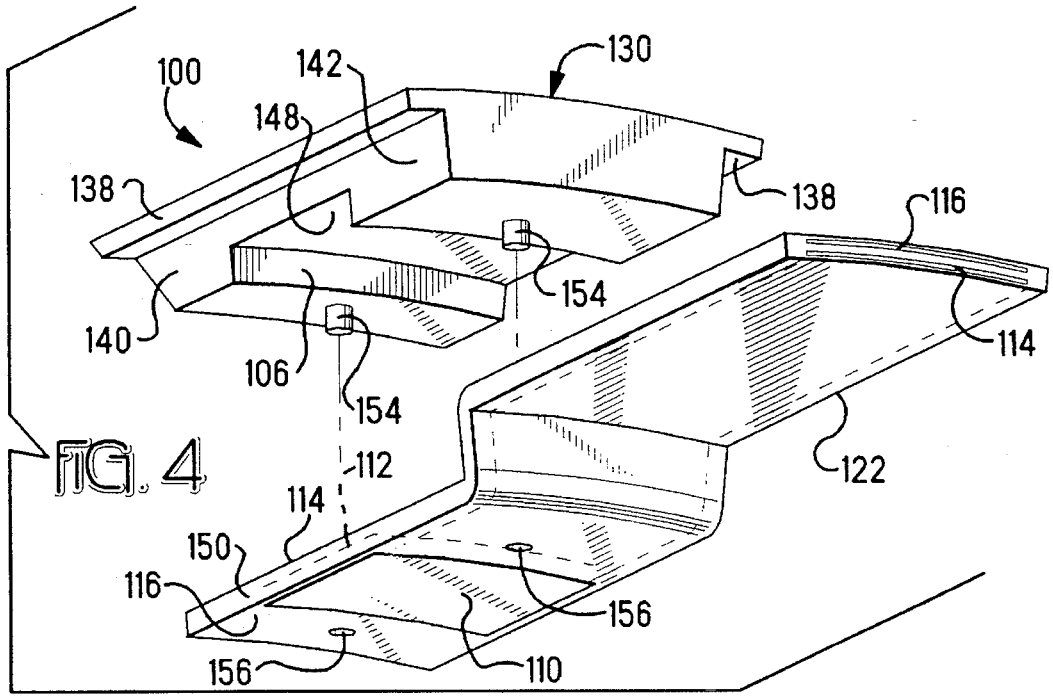
FIG. 4 is an isometric view of the receptacle connector of FIG. 1 showing the flexible film circuit element positioned to be affixed to the receptacle housing.

Second connective arrangement 100 will be referred to as the receptacle connector 100 and is seen in FIGS. 1 and 4, and is defined on shell 102 ate a position associated with plug connector 10 when shells 12, 102 are moved from the first position to the second position to mate with the plug connector. Receptacle connector 100 comprises a blade-shaped dielectric member 104 traversing a contact-receiving recess 106 at a mating face 108 opposed to mating face 46 of plug connector 10. Blade-shaped dielectric member 104 is mounted to oppose the diverging free ends 38, 40 of the spring arms 28, 30 of contact members 14, 16 of plug connector 10 to be received edgewise therebetween. The blade-shaped member includes contact pads 110, 112 exposed on opposed major surfaces 114, 116 of the blade-shaped member connected to respective circuits 118, 120 of shell 102 (represented by dashed lines in FIG. 1), with contact pads 110, 112 electrically engageable with corresponding ones of the contact surfaces 42, 44 of contact members 14, 16 of the plug connector upon mating of the plug and receptacle connectors.

Blade-shaped member 104 may be a portion of a flexible film element 122 and contact pads 110, 112 may be exposed portions of two conductors thereof otherwise embedded within layers of insulative film, which conductors define circuits 118, 120 electrically connected to another electrical article (not shown) mounted on shell 102 remote from receptacle connector 100 to which flexible film circuit 122 extends.

Receptacle connector 100 may include a discrete housing member 130 mounted to shell 102 in a recess 132 extending inwardly therethrough from outer surface 134 to inner surface 136, with housing member 130 shown to include a pair of flange sections 138 abutting against outer shell surface 134 for positioning. Housing member 130 is shown to include upstanding portions 140, 142 having coplanar support surfaces 144, 146 to and against which the flexible film end portion 150 is affixed such as by using adhesive or bonding agent, so that portion 152 thereof traverses recess 106 between upstanding portions 140, 142 to define the blade-shaped member 104. Embossments 154 are shown protruding from support surfaces 144, 146 to extend through corresponding holes 156 punched through film end portion 150 for precise positioning thereof during assembly, and heat staked thereafter to define joints 154A (FIGS. 5 and 6) affixing element 122 to housing 130 and providing strain relief thereafter. Tape may be used to secure housing member 130 in recess 132 and flexible film element 122 to and along outer surface 134 of shell 102, or a molded low-profile cover member may be secured thereover.

Figure 5:
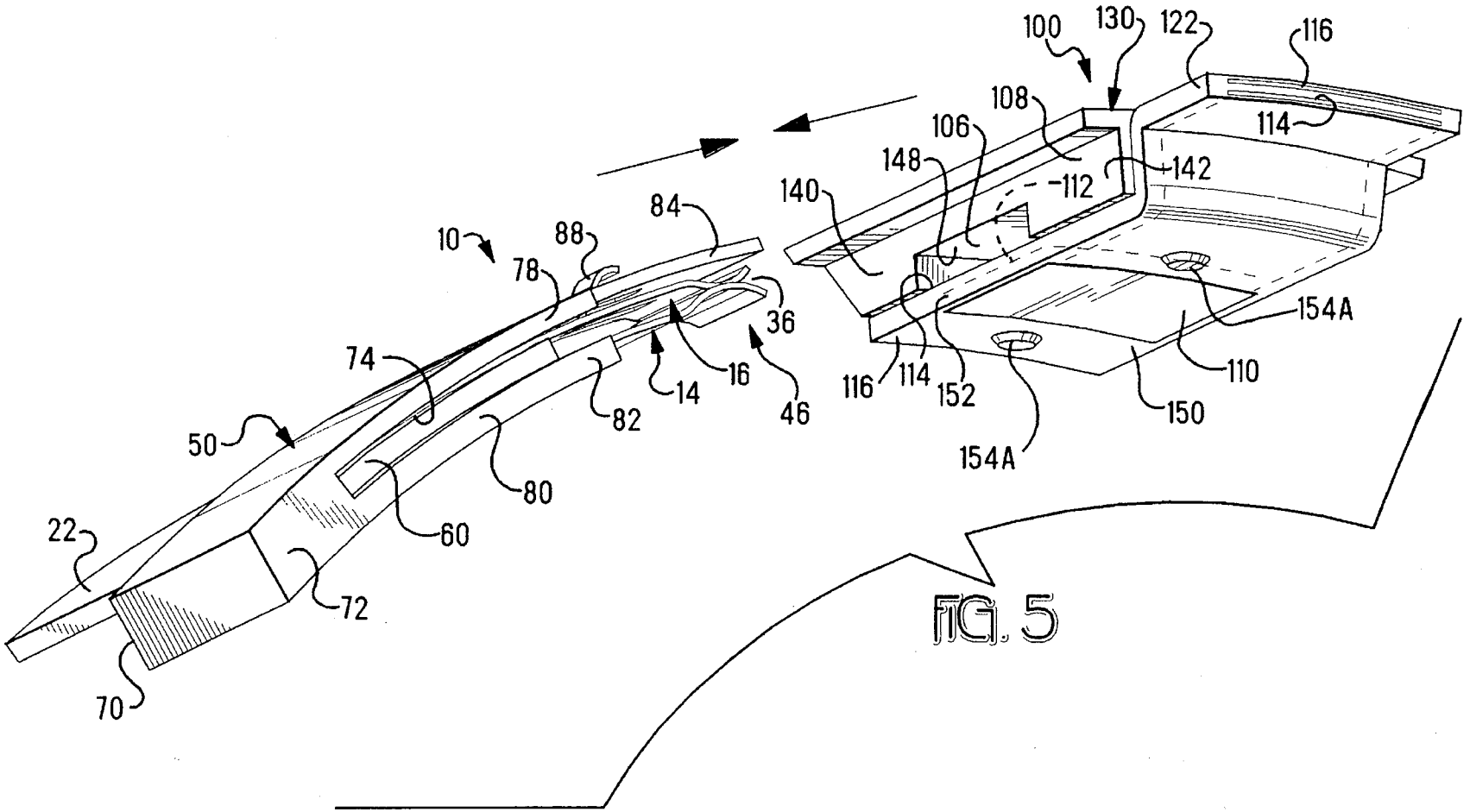
FIGS. 5 and 6 are isometric views of the plug and receptacle connective arrangements of FIG. 1 positioned to be mated with the cylindrical shells not shown.
Figure 6:
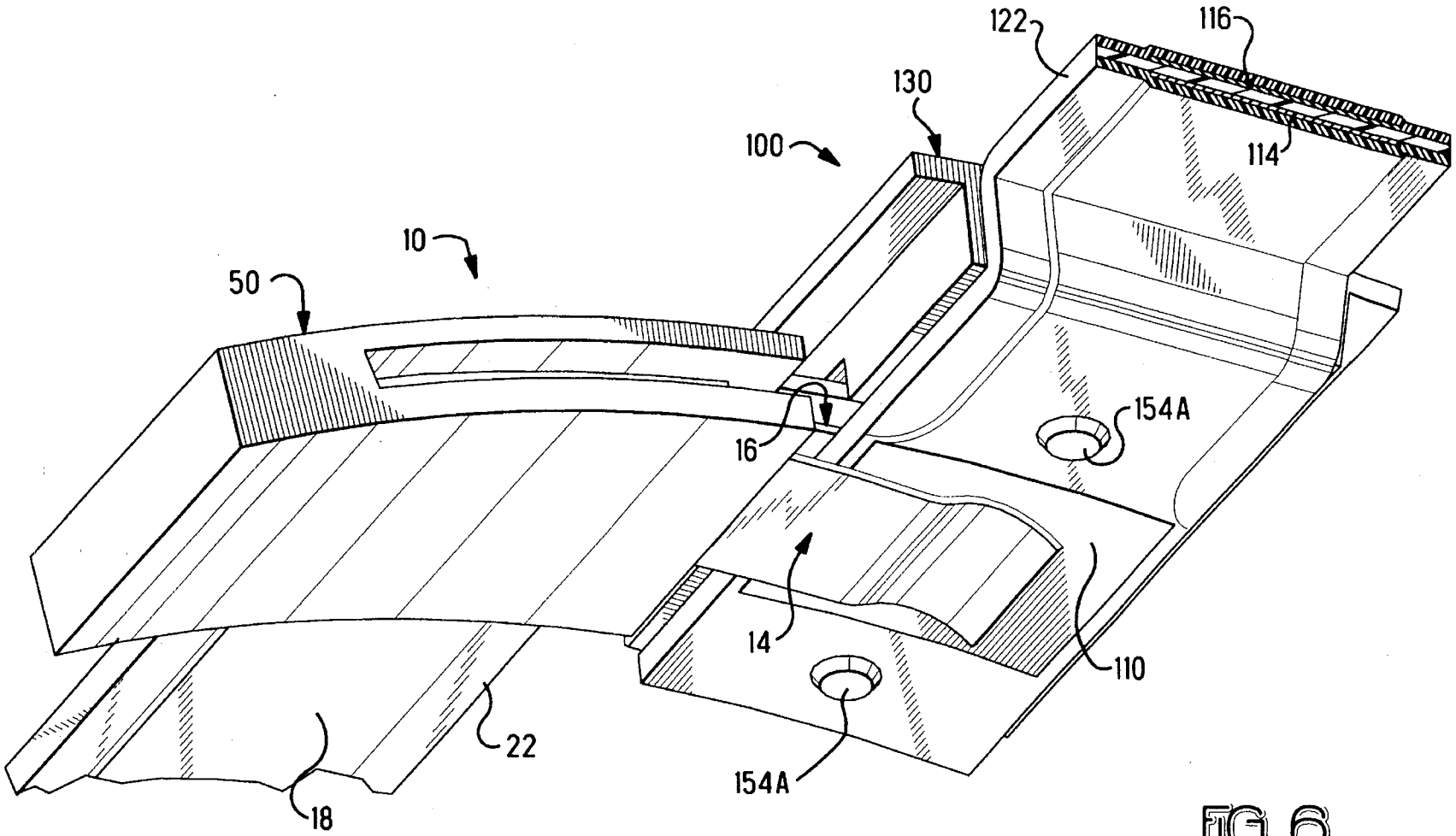

FIGS. 5 and 6 are views of the plug and receptacle arrangements of FIGS. 1 to 4 from different perspectives, with the shell members removed for clarification, and before and after connector mating.

Figure 7:
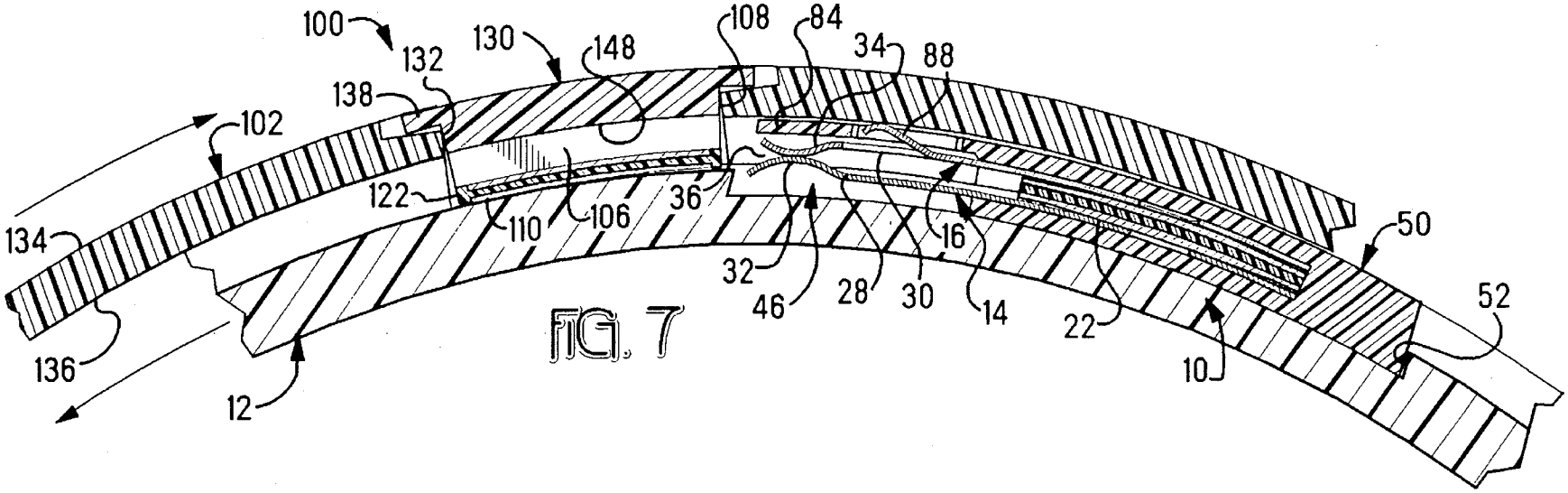
FIGS. 7 and 8 are enlarged longitudinal section views of the plug and receptacle connectors of FIGS. 1 to 6 shown prior to and after mating.
Figure 8:
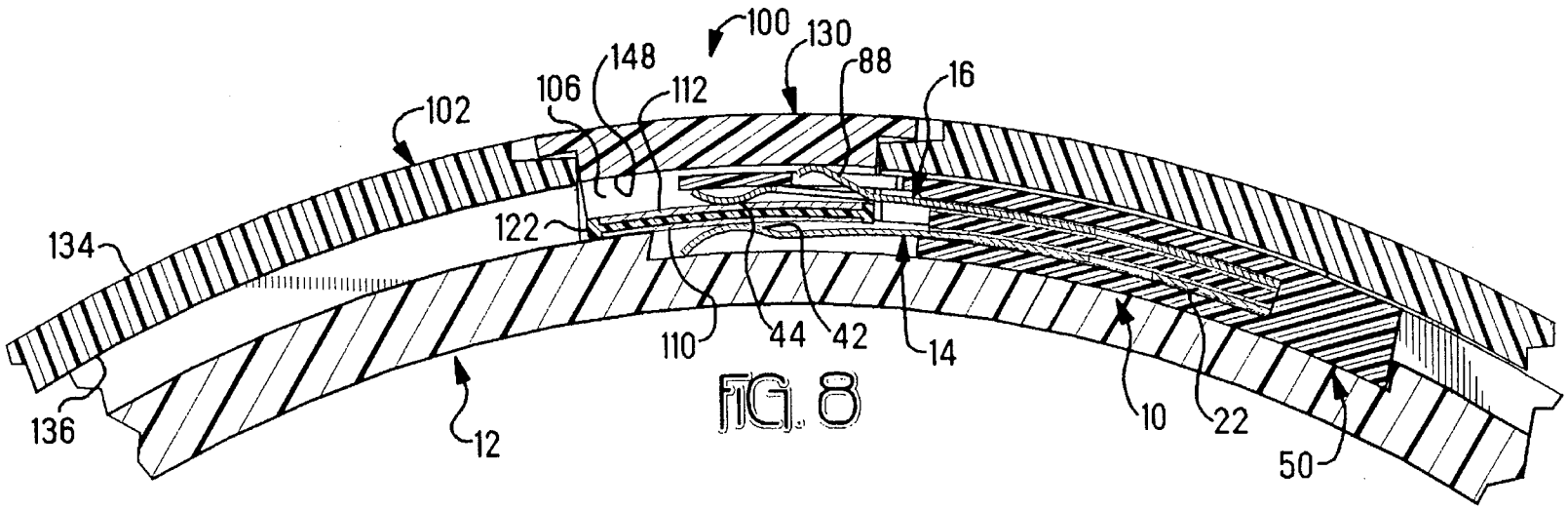

FIGS. 7 and 8 also illustrate in elevation view, the mating of plug and receptacle connectors 10, 100 as shells 12, 102 are relatively rotated about a common axis from a first position defining an unmated condition in which the circuits are interrupted, to a second position defining a mated connector condition in which the circuits are completed at the mating interface of the connectors. Blade-shaped member 104 is received into the blade-receiving entrance between free ends 38, 40 of spring arms 28, 30 of contact members 14, 16 of plug connector 10, with contact surfaces 42, 44 at constriction 36 engaging and bearing against upper and lower surfaces 116, 114 of blade-shaped member 104 deflecting the spring arms relatively apart, and with contact surfaces bearing against contact pads 110, 112 upon full mating.

Reference to FIG. 7 reveals that spring finger 88 prior to mating is adapted to abut and bear against inner surface 136 of shell 102 to urge contact member 16 toward and against contact member 14. This arrangement permits the pair of contact members to be assuredly electrically engaged to each other at contact surfaces 42, 44 enabling a shunt circuit to be defined preventing a false reading of completed circuits to be received at the electrical article of shell 12 to which the circuits 18, 20 are connected.

Recess bottom surface 148 of receptacle connector 130 is cooperable with protruding spring finger 88 of plug connector 10 such that spring finger 88 engages and bears against recess bottom surface 148 to be deflected inwardly toward contact members 14, 16 during and after connector mating to facilitate generation of assured normal force to maintain assured electrical engagement of contact surfaces 42, 44 of contact members 14, 16 against contact pads 110, 112 of blade-shaped member 104 of receptacle connector 100 thereby assuring continuity of electrical connection of the circuits after connector mating. It is preferable that the forward end of spring finger 88 be angled so that upon initial engagement with the front surface of housing 130 adjacent contact-receiving cavity 106, spring finger 88 is deflected toward contact member 16 upon bearing against the corner of front surface and the bottom cavity surface 148.

Housing members 50, 130 of plug connector 10 and receptacle connector 100 may be for example molded of thermoplastic material such as NORYL GTX830 polyphenylene oxide resin sold by The General Electric Company. The housing members may be potted into place within recesses 52, 132, or bonded therein, or secured therein by tape. Contact members 14, 16 may be stamped and formed from an 0.0080 inch thick strip of conductive metal such as phosphor bronze copper alloy with gold plating over nickel underplating. Flexible film circuit elements 22, 122 may be conventionally fabricated using polyimide-clad copper circuits disposed within layers of dielectric film such as for example of KAPTON polyimide resin sold by E. I. DuPont de Nemours and Co., with the layers bonded together by acrylic adhesive. Exposed conductive pads 62, 64 and 110, 112 of the copper circuits of flexible film circuit elements 22, 122 are preferable gold plated over nickel underplating.

Figures 9, 10:
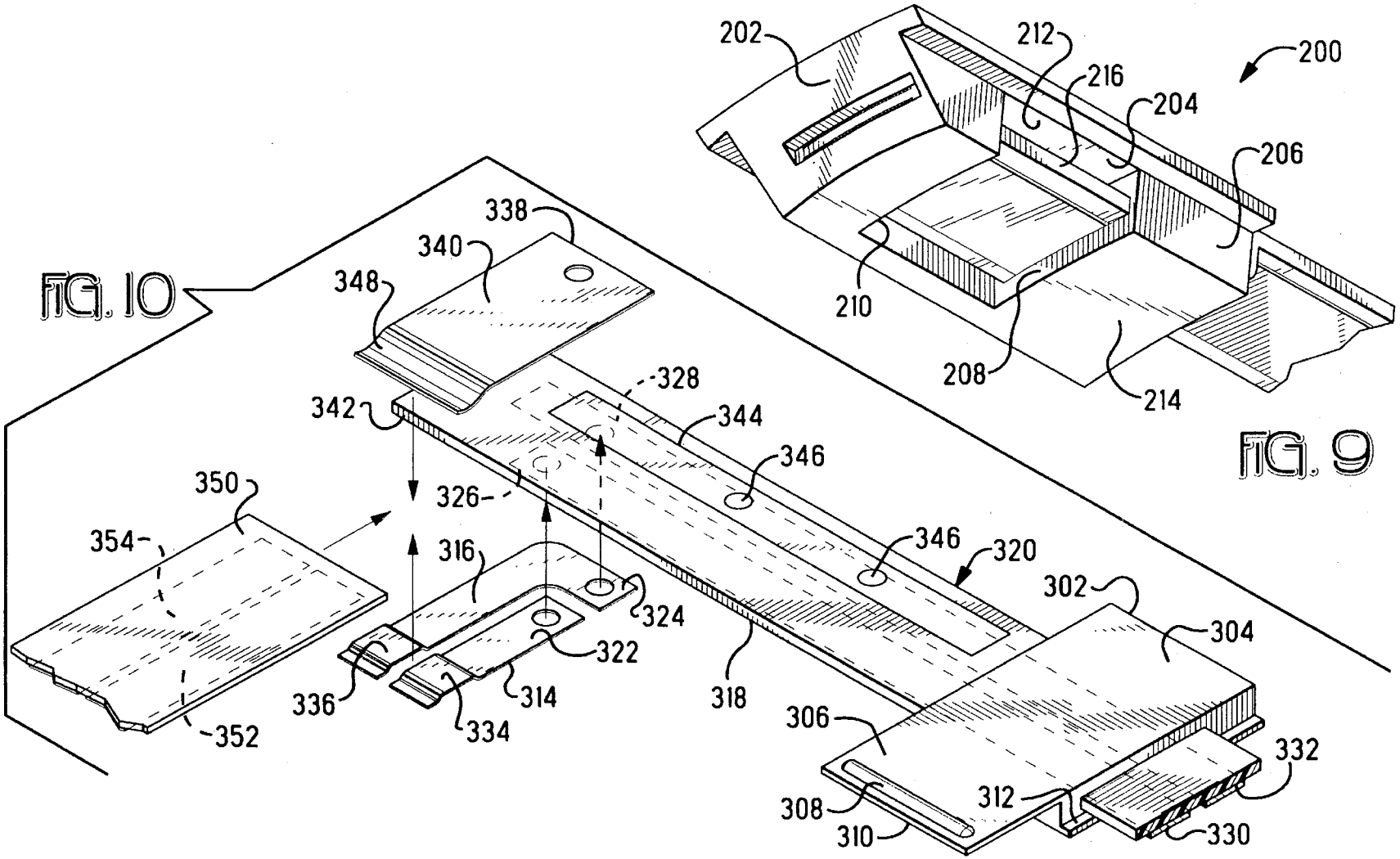
FIG. 9 is an isometric view of an alternative embodiment of the receptacle of the present invention.
FIG. 10 is an isometric view of an alternative embodiment of the plug housing of the present invention, and showing a different contact arrangement.

Alternatively, as shown in FIG. 9, the receptacle connector may be an embodiment of connector 200 which includes a discrete housing 202 which may define a recess 204 open at mating face 206 thereof between end walls 208, 210 of dielectric material. A flexible film portion 216 traverses the recess between side walls 208, 210 thereof midway between an outer wall 212 of the housing and an interior face 214, so that the ends of the spring arms of the contact members of the mating plug connector are received along the opposed sides of the flexible film portion 216 and within recess 204. Flexible film portion 216 may be potted or bonded in place, or a planar lower housing section may be bonded or heat staked to an upper housing section trapping the flexible film portion in place therebetween (not shown).

An alternative embodiment of the plug connector 300 is shown in FIG. 10, having a housing member 302 with an outer surface 304 forwardly from which extends a tab section 306 similar to tab section 84 of plug connector 10 of FIG. 1. Tab section 306 includes an outwardly extending embossment 308 near forward end 310 and engageable with the inner surface of the shell containing the receptacle connector (not shown), such as is shown in FIG. 7 prior to connector mating, and with the cavity bottom 148 as shown in FIG. 8 upon mating. Such engagement enables tab section 306 to be urged inwardly against the adjacent contact member to urge it against the opposing contact member (or members) prior to connector mating, similarly to contact member 14 being urged against contact member 16 in FIG.

7, and against the associated circuit pad 112 of the receptacle connector as seen in FIG. 8 upon connector mating. Embossment 308 preferably has rounded or angled corners and edges to prevent snagging or snubbing against other surfaces during assembly and during mating.

Housing 302 also is shown to have flanges 312 extending from side walls thereof, similarly to flanges 138 of housing 130 of receptacle connector 100 of FIG. 5, enabling placement of the housing into an opening through the inner shell as the flanges abut against the inner surface of the shell.

FIG. 10 also illustrates an alternate arrangement of contact members of the plug connector. Plug connector 300 includes first and second contact members 314, 316 both secured to the bottom surface 318 of flexible film circuit element 320 by body sections 322, 324 being soldered to respective contact pads 326, 328 along the bottom film surface 318 in electrical engagement with conductors 330, 332 of the film element. Spring arm contact sections 334, 336 coextend in a common plane adjacent each other and are matable with corresponding contact pads exposed along the bottom surface of a flexible film circuit element of the complementary receptacle connector (not shown). A third contact member 338 has a body section 340 secured to the top surface 342 of flexible film circuit element 320 such as by being soldered to a contact pad 344, shown commoned to one of the conductors of the film element and thus one of the contact pads 326, 328 by one or more plated through holes 346. The third contact member includes a wide spring arm contact section 348 that cooperates with the pair of spring arm contact sections 334, 336 the first and second contact members opposed therefrom to clamp to the flexible film circuit element 350 of the receptacle connector upon mating, to assure sufficient force to establish an electrical connection between the contact members and the contact pads 352, 354 of flexible film circuit element 350. The third contact member also may serve as a shunt when its wide spring arm contact section is biased against opposed spring arm contact sections 334, 336, commoning the first and second contact members 314, 316 prior to connector mating to provide a closed circuit, until urged away therefrom by flexible film circuit element 350 upon mating. In lieu of an upper contact 338, a conductive embossment may be secured to the lower surface of tab section 306 without being connected to a circuit of film 320, electrically connecting lower contacts 314, 316 before mating.

Variations and modifications of the above-described embodiments may be devised which are within the spirit of the invention and the scope of the claims.

We claim:

1. A matable electrically connective assembly of the type having a first connective arrangement defined on a first surface of a first article and a second connective arrangement defined on a second surface of a second article adjacent and alongside the first article with the second surface adjacent and alongside the first surface, with the first and second articles movable from a first position to a second position with their first and second surfaces slidable along each other, comprising:

a first connective arrangement defined on a first article along a first surface thereof and including substantially flat first and second contact members having body sections secured to a dielectric support section, said first connective arrangement including a mating face along which are exposed opposing spring arm contact sections of said first and second contact members coextending from said body sections thereof, a connection section of each of said contact members being electrically connected to a respective circuit of said first article; and a second connective arrangement defined on a second article adjacent and alongside said first article, said second connective arrangement being defined along a second surface thereof opposed to said first surface of said first article with said first and second surfaces in overlying relationship at least in said second position, said second connective arrangement including a dielectric member having a blade shape traversing a contact-receiving recess at a mating face thereof and being adapted to be received edgewise between said first and second spring arm contact sections of said first connective arrangement upon mating, said dielectric member including first and second contact pads electrically connectable to first and second circuits of sad second article respectively, said first and second contact pads being defined on opposed major surfaces of said dielectric member and associated with respective ones of said first and second contact members of said first connective arrangement, said first and second connective arrangements being matable upon said first and second articles being moved from said first position to said second position such that said blade-shaped dielectric member is received between leading ends of said first and second spring arm contact members deflecting them apart, and said first and second contact pads on said blade-shaped dielectric member become electrically engaged with corresponding first and second contact surfaces of said first and second contact members upon full mating, thereby completing first and second circuits of the articles in response to the first and second articles being completely moved to said second position.

2. The connective assembly as set forth in claim 1 wherein said first and second spring arm contact sections of said first and second contact members of said first connective arrangement, are initially spring biased against each other in electrically conductive relationship at said first and second contact surfaces prior to mating, defining a shunt establishing a closed loop of said respective circuits of said first article prior to said first and second articles being moved to said second position.

3. The connective assembly as set forth in claim 1 wherein said first and second connective arrangements include respective structures of dielectric material generally surrounding and protecting said first and second contact members and said blade-shaped member respectively.

4. The connective assembly as set forth in claim 3 wherein said structures of dielectric material are discrete first and second housings mountable to said first and second articles.

5. The connective assembly as set forth in claim 4 wherein at least one of said first and second housings includes flange portions extending laterally from side walls thereof sufficient to extend beyond the peripheral edge of a pocket extending through a respective panel member to which said at least one housing is to be secured, enabling said at least one housing to secured in said pocket with said flange portions abutting panel surfaces surrounding the periphery of said pocket.

6. The connective assembly as set forth in claim 1 wherein said second connective arrangement includes a second dielectric housing, and said dielectric member is defined by an end portion of a second flexible film circuit element traversing a contact-receiving cavity and having said contact pads defined on upper and lower surfaces thereof electrically connected to conductors of said second flexible film circuit element.

7. The connective assembly as set forth in claim 6 wherein said contact-receiving cavity is in communication with a bottom surface of said second housing, and said second flexible film circuit element is affixed along said bottom surface of said second housing.

8. The connective assembly as set forth in claim 7 wherein said bottom surface of said second housing includes embossments to either side of said contact-receiving cavity that are initially extended through corresponding holes through said second flexible film circuit element and staked thereto, locating and affixing said second flexible film circuit element to said second housing.

9. The connective assembly as set forth in claim 1 wherein said first connective arrangement includes a first dielectric housing forwardly from a mating face of which extend said opposing spring arm contact sections of said first and second contact members, said first housing having a cavity extending thereinto from said mating face shaped and dimensioned to closely house said body sections of said first and second contact members and terminations thereof to respective said circuits.

10. The connective assembly as set forth in claim 9 wherein said circuits are defined in a first flexible circuit element having respective contact pads defined on opposed major surfaces at an end portion thereof, with said body sections of said first and second contact members terminated thereto to define a contact subassembly, and said first flexible circuit element extends from a cable exit of said housing.

11. The connective assembly as set forth in claim 10 wherein said body sections of said first and second contact members include apertures therethrough facilitating formation of solder joint fillets upon said first and second contact members being soldered to said contact pads.

12. The connective assembly as set forth in claim 10 wherein said cable exit is defined in a side wall of said first housing orthogonal to said mating face, and an opposing side wall of said housing includes an aperture extending therealong in communication with said mating face and said cavity, enabling said contact subassembly to be urged into said housing from outwardly of said opposing side wall by deflection of upper and lower housing portions apart until said contact subassembly is seated within said cavity.

13. The connective assembly as set forth in claim 12 wherein said cavity along said opposing side wall includes ledges along said upper and lower portions facing said cavity adapted to coextend along side edges of said body sections of said contact members upon seating of said contact subassembly in said cavity.

14. The connective assembly as set forth in claim 9 wherein said first housing includes a tab section projecting forwardly of said mating face from an upper housing portion, and a projection extends upwardly of said tab section away from said mating face to be engaged to urge said spring arm of an upper one of first and second contact members toward and against said spring arm of a lower one thereof prior to mating to assure electrical engagement between said first and second contact members prior to connector mating, and to urge said spring arm of said upper one of said first and second contact members toward and against a corresponding contact pad of said dielectric member of said second connective arrangement upon mating to assure electrical engagement therebetween.

15. The connective assembly as set forth in claim 14 wherein said projection is a spring finger defined on said upper one of said first and second contact members extending through an aperture of said tab section.

16. The connective assembly as set forth in claim 14 wherein said projection is an embossment defined on an upper surface of said tab section, and said tab section is deflectable at least toward said upper one of said first and second contact members.

17. The connective assembly as set forth in claim 14 wherein said projection includes a sloped forwardly facing surface to prevent stubbing upon initial engagement with a forward surface of second dielectric structure housing said second connective arrangement, at said mating face thereof during connector mating.

18. A matable electrically connective assembly of the type having first and second connective arrangements defined on opposing adjacent first and second surfaces of first and second articles respectively, with the first and second articles movable from a first position to a second position with their first and second surfaces slidable along each other, comprising:

a first connective arrangement defined on a first article along a first surface thereof and including flat first and second contact members having body sections secured to a dielectric support section, and a third contact member having a body section secured to said dielectric support section opposite said first and second contact members, said first connective arrangement including a mating face along which are exposed spring arm contact sections of said first and second contact members and opposing third contact member coextending from said body sections thereof, a connection section of at least said first and second contact members being electrically connected to a respective circuit of said first article; and a second connective arrangement defined on a second article along a second surface thereof opposed to said first surface of said first article with said first and second surfaces in overlying relationship at least in said second position, said second connective arrangement including a dielectric member having a blade shape traversing a contact-receiving recess at a mating face thereof and being adapted to be received edgewise between said first and second spring arm contact sections and said opposing third spring arm contact section of said first connective arrangement upon mating, said dielectric member including first and second contact pads electrically connectable to first and second circuits of said second article respectively, said first and second contact pads being defined on a common major surface of said dielectric member and associated with respective ones of said first and second contact members of said first connective arrangement, said first and second connective arrangements being matable upon said first and second articles being moved from said first position to said second position such that said blade-shaped dielectric member is received between leading ends of said first and second spring arm contact members and of said opposing third spring arm contact member deflecting them apart, and said first and second contact pads on said blade-shaped dielectric member become electrically engaged with corresponding first and second contact surfaces of said first and second contact members upon full mating, thereby completing first and second circuits of the articles in response to the first and second articles being completely moved to said second position.

19. The connective assembly as set forth in claim 18 wherein said third contact member is electrically connected to one of said first and second circuits and is biased against said first and second contact members prior to connector mating to define a shunt electrical connection therebetween.

20. An assembly of first and second articles having at least first and second circuits closable at an electrically connective interface when the first and second articles are moved along a predetermined path from a first position to a second position, comprising:

a first article having a first connective arrangement defined on a first surface thereof and a second article having a second connective arrangement defined on a second surface thereof opposing said first surface and adjacent thereto, said first and second articles being assembled to each other in a manner permitting movement from a first position along a predetermined path to a second position with said first and second surfaces moving alongside each other in a selected direction, to move said first and second connective arrangements along a mating axis to become electrically engaged to complete said at least one circuit;

said first connective arrangement including at least a first contact member electrically connected at a connection section to a respective said at least one circuit of said first article and secured to a dielectric support mounted to said first article, said first contact member including a spring arm contact section exposed at a first end of said mating axis for electrical engagement;

said second connective arrangement including at least a first contact means electrically connected at a connection section to a respective said at least one circuit of said second article and secured to a dielectric support mounted to said second article, said first contact means being at least defined on a major surface of a blade-shaped member traversing said mating axis and exposed at a second end of said mating axis for electrical engagement with said spring arm contact section of said first contact member upon mating.

21. The arrangement of claim 20 wherein one of said first and second connective arrangements is disposed recessed beneath one of said first and second surfaces.

22. The arrangement of claim 21 wherein a groove is defined into said first surface forwardly of said at least one spring arm contact section, and said blade-shaped member is affixed within a structure shaped and dimensioned to be received into and along said groove during movement of said first and second articles to said second position, such that said blade-shaped member is moved to said at least one spring arm contact section for mating.

23. The arrangement of claim 20 wherein said first and second surfaces are concentric and are movable about a common axis from said first to said second position.

* * * * *